United States Patent [19]

Tirelli

[11] Patent Number: 5,040,355

[45] Date of Patent: Aug. 20, 1991

[54] METHOD AND A LABELLING MACHINE FOR ATTACHING WRAPPER LABELS TO THE NECK PORTION OF BAG-TYPE PACKAGES AND THE LIKE

[75] Inventor: Ettore Tirelli, Parma, Italy

[73] Assignee: Barilla G.E.R. F. LLI, Italy

[21] Appl. No.: 501,982

[22] Filed: Mar. 30, 1990

[30] Foreign Application Priority Data

Mar. 31, 1989 [IT] Italy ..... 19981 A/89

[51] Int. Cl.[5] ..... B65B 51/04

[52] U.S. Cl. ..... 53/417; 53/138.3

[58] Field of Search ..... 53/128, 138 A, 138 R, 53/416, 417, 583; 156/DIG. 23

[56] References Cited

U.S. PATENT DOCUMENTS

| | | | |
|---|---|---|---|
| 3,021,654 | 2/1962 | Harris | 53/138 A |
| 3,061,983 | 11/1962 | Irwin | 53/417 |
| 3,099,116 | 7/1963 | Platt, Jr. et al. | 53/583 X |
| 3,163,969 | 1/1965 | Irwin et al. | 53/417 |
| 3,163,970 | 1/1965 | Paxton | 53/138 A |
| 3,270,481 | 9/1966 | Rocholl | 53/417 |
| 3,412,895 | 11/1968 | Hilton | 53/138 A X |
| 3,621,632 | 11/1971 | Browning | 53/138 A |
| 3,668,818 | 6/1972 | Holmes | 53/138 A X |
| 3,983,681 | 10/1976 | Britt et al. | 53/583 X |
| 4,648,531 | 3/1987 | Won | 53/417 X |

*Primary Examiner*—Robert L. Spruill
*Assistant Examiner*—Daniel B. Moon
*Attorney, Agent, or Firm*—Sughrue, Mion, Zinn, Macpeak & Seas

[57] ABSTRACT

For attaching, to the neck portion of a bag-type package, a respective wrapper label held in an upright position, side-by-side extensions of the label are grasped from below, slightly twisted to spread them out, fitted over the neck portion and released such that, in springing back to their original side-by-side position, they will wrap around said neck portion.

6 Claims, 8 Drawing Sheets

METHOD AND A LABELLING MACHINE FOR ATTACHING WRAPPER LABELS TO THE NECK PORTION OF BAG-TYPE PACKAGES AND THE LIKE

BACKGROUND OF THE INVENTION

This invention relates to a method of attaching wrapper labels to the neck portions of bag-type packages and the like. The invention is also concerned with a labelling machine for implementing this method.

Throughout the description which follows and the appended claims, the term "wrapper label" means a label having a pair of parallel coplanar extensions which lie side-by-side and define a passageway therebetween collar-fashion, the label dimensions being selected to enable it to be wrapped fully around the neck portion of a bag-type package.

Labels of this kind are widely and advantageously used to provide indications of the contents, origin, price, and a variety of other information on the packaged object or product, as well as possible related advertisements or usage instructions.

It is a current practice to attach wrapper labels to respective bag packages manually; an operator will spread open the extensions of each label by bending them in opposite directions, thereby providing access to the collar-like passageway defined by them in a radial direction, and then wrap them around the bag.

This procedure has all the well-recognized disadvantages of manual operations, namely: slowness, poor reliability, low output, high labor requirements to achieve acceptable rates, etc.

In addition, such disadvantages are made even more serious by that package labelling, especially with bag-type packages, is usually the last operation to be performed on a production and packaging line which is otherwise fully automated.

The problem that underlies this invention is to provide a method which has such functional characteristics as to enable wrapper labels to be attached to bag-type packages in a fully automated manner, which label attachment can be carried out at any in a wide range of operational rates, all affording reliability to a high degree.

SUMMARY OF THE INVENTION

This problem is solved according to the invention by a method of attaching wrapper labels to the neck portions of bag-type packages and the like, said wrapper labels being of a type comprising a label formed with two parallel coplanar extensions defining a collar-like passageway therebetween, characterized in that it comprises the steps of, positioning a bag-type package on a rest surface such that the neck portion thereof will extend horizontally beyond said surface, positioning a label vertically while holding it vertically above the neck portion of said package at a location overlying it with the collar-like passageway of said label substantially centered on said neck portion, gripping the ends of said extensions from below by respective substantially wrench-like gripping means, slightly twisting said extensions by appropriate rotation of said wrench-like means, thereby spreading them open to make the collar-like passageway defined therebetween accessible, bringing the label vertically down while holding its respective extensions spread out so as to engage them on either sides of said neck portion, thereby the latter will become wrapped within said collar-like passageway, and moving said substantially wrench-like gripping means away from the respective extensions by further lowering said means while the label is withheld on the neck portion of said package.

This invention also relates to a labelling machine for implementing the method, which machine is characterized in that it comprises: a rest surface whereon a bag-type package is held in a work position with the neck portion of the package horizontally proud of said surface; a label magazine: a device for picking up a label from said magazine and holding the same upright vertically above the neck portion of said package; a slide movable along ways extending vertically beneath said rest surface; substantially wrench-like gripping means supported on said slide and comprising two rods having vertical axes and top ends formed with cutouts for engaging end portions of respective extensions of said label from below; and means for driving said rods angularly in one direction and in the opposite direction about their respective vertical axes.

BRIEF DESCRIPTION OF THE DRAWINGS

The advantages and features of the method and labelling machine of this invention will be more clearly apparent from the following detailed description, given herein with reference to the accompanying illustrative and non-limitative drawings, where.

DETAILED DESCRIPTION OF THE INVENTION

Figure 1:
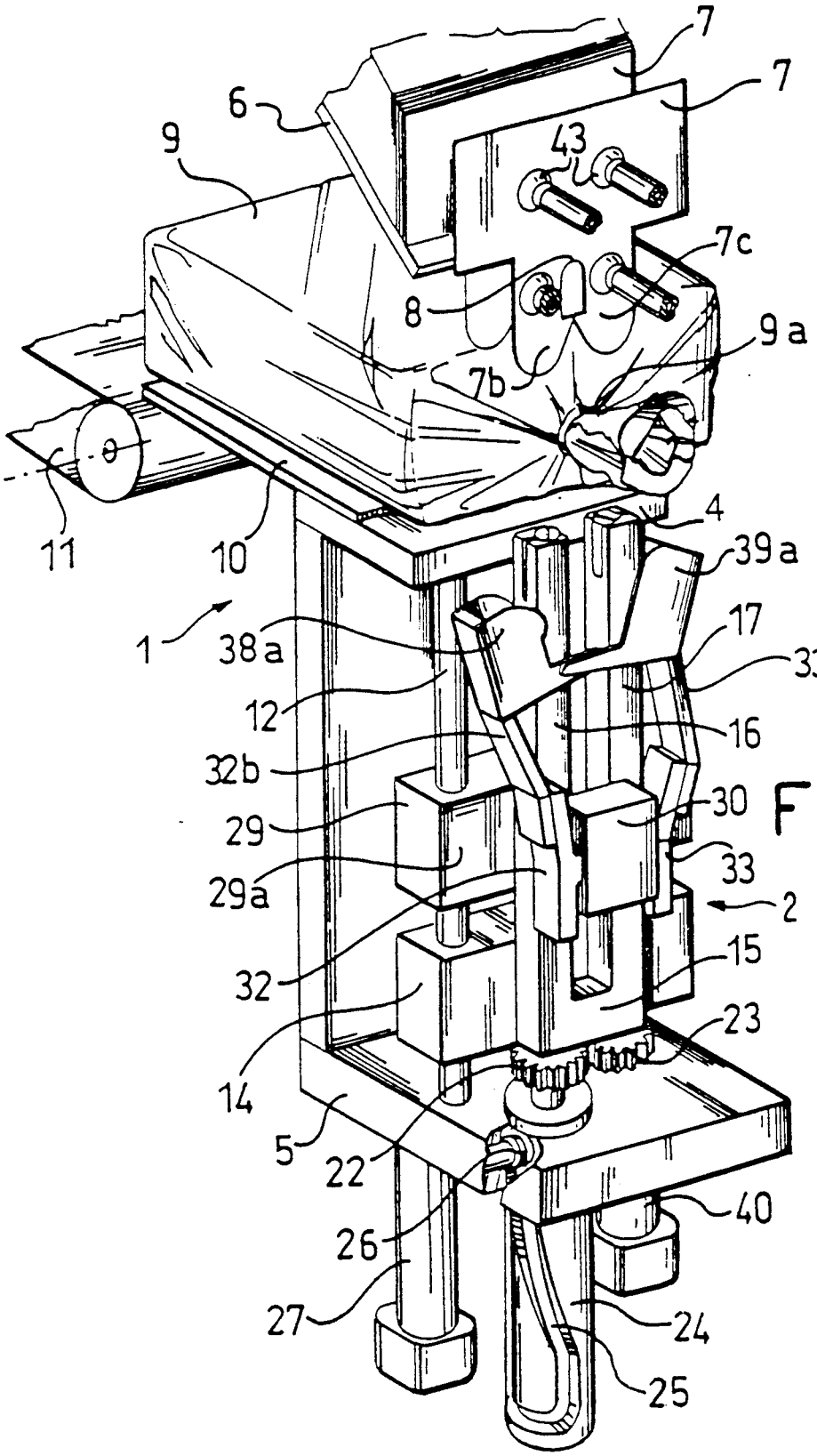
FIG. 1 shows in perspective a labelling machine according to the invention.

With reference to the drawing views, a labelling machine 1 according to the invention comprises a label handling device, generally indicated at 2, which is supported, in a manner to be described, on a U-shaped frame 3 having upper 4 and lower 5 horizontal legs of different lengths.

A magazine 6 for wrapper labels 7 is carried at a location overlying said frame 3.

The labels 7 are made of a suitable paper material, such as thin pasteboard, and of a type which comprises a rectangular portion *7a* of relatively large size provided with a pair of identical, coplanar side-by-side extensions *7b* and *7c* which define an essentially collar-like passageway 8 therebetween having suitable shape and dimensions to fit over the neck portion *9a* (wrapped around it) of a bag-type package 9.

Within the magazine 6, which is an essentially channel-like shape, said labels 7 are arranged upright with extensions *7b*, *7c* depending downwards. To permit of this layout of the labels 7, the bottom wall of the magazine 6 is formed longitudinally with a slot 6*a* extending along the middle thereof, whose width is at least equal to the width of said side-by-side label extensions.

A horizontal rest surface 10 for a bag package 9 to be labelled is supported at an intermediate location between the magazine 6 and the frame 3, e.g. bearing on the top leg 4 of said frame. On said rest surface 10, the bag packages 9 are fed, one by one such as by means of a conveyor 11, in accordance with well-known practices and procedures.

The opposed legs 4, 5 of the frame 3 support a pair of vertical cylindrical ways or guides 12, 13 on which a first slide 14 is mounted for sliding movement. Attached to the wall 4*a* of said slide 14 which faces outwards from the frame 3 is a U-shaped holder 15 having vertical elongate arms 16, 17 which impart a substantially tuning fork-like appearance to said holder 15.

The arms 16, 17 have respective bores 16*a*, 17*a* extending longitudinally therethrough, each having a rod 18, 19 mounted for rotation inside the bores.

The rods 18, 19 have top ends formed with respective diametrical cutouts 20, 21 of equal axial length. The rods 18 and 19 have projected support sections 15, at their other ends, and keyed to these projected sections of the rods 18 and 19 are respective identical gear wheels 22, 23 enmeshing with each other.

Attached coaxially to the gear wheel 22 is a cylindrical segment 24 supported and guided slidably and rotatably in a passageway 5*a* through the bottom leg 5 of the holder frame 3.

The cylindrical segment 24 is formed with a suitably shaped groove 25 which provides the profile of an internal cam with which a roller-type follower 26 engages constantly which is carried fixedly on the bottom leg 5 of the frame 3.

For displacing the slide 14 along the cylindrical ways 12, 13, a vertical double-acting air cylinder 27 is advantageously used whose piston rod (not shown) acts on the slide 14.

A second slide 29 is mounted slidably on these same ways 12 and 13 which has a box-type body 30 attached to its wall 29*a* facing away from the frame 3. More specifically, said body 30 locates outwardly of the holder 15 for the first slide 14, and is connected to its respective slide 29 by a horizontal arm 31 extending between the arms 16, 17 of the holder 15.

Two identical levers 32, 33 are pivoted on opposed sides of the box-type body 30, around respective pivot pins 34 and 35 which are set equal distances apart from the vertical axis of said body 30, which axis is coincident with the vertical axis of the holder 15.

Figure 2:
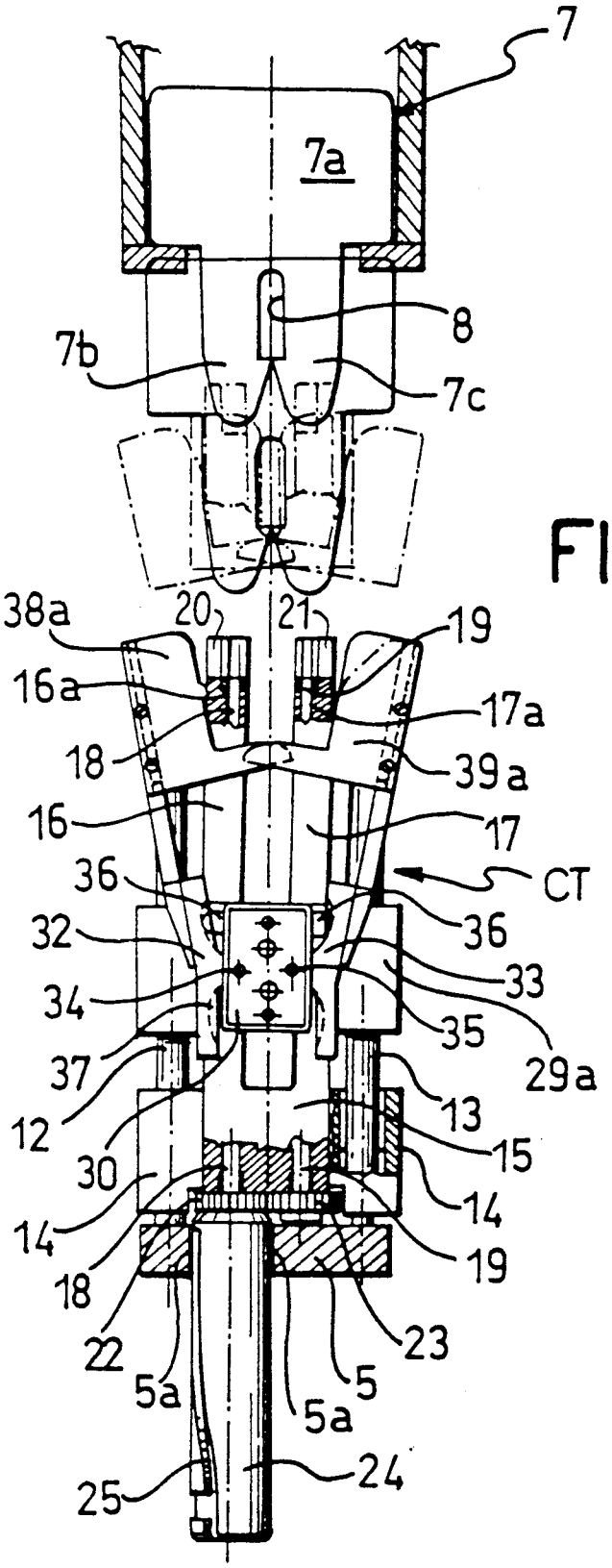
FIG. 2 is an enlarged scale, part-sectional front view of a detail of the machine shown in FIG. 1.

The angular displacements of the levers 32 and 33 around their respective pivot pins 34, 35 take place in a vertical plane, are equal in amount and opposite in direction, and are performed through two pairs of air cylinders supported on the box-type body 30, of which only the upper 36, 36 and lower 37, 37 piston rods are shown in FIG. 2.

Figure 3:
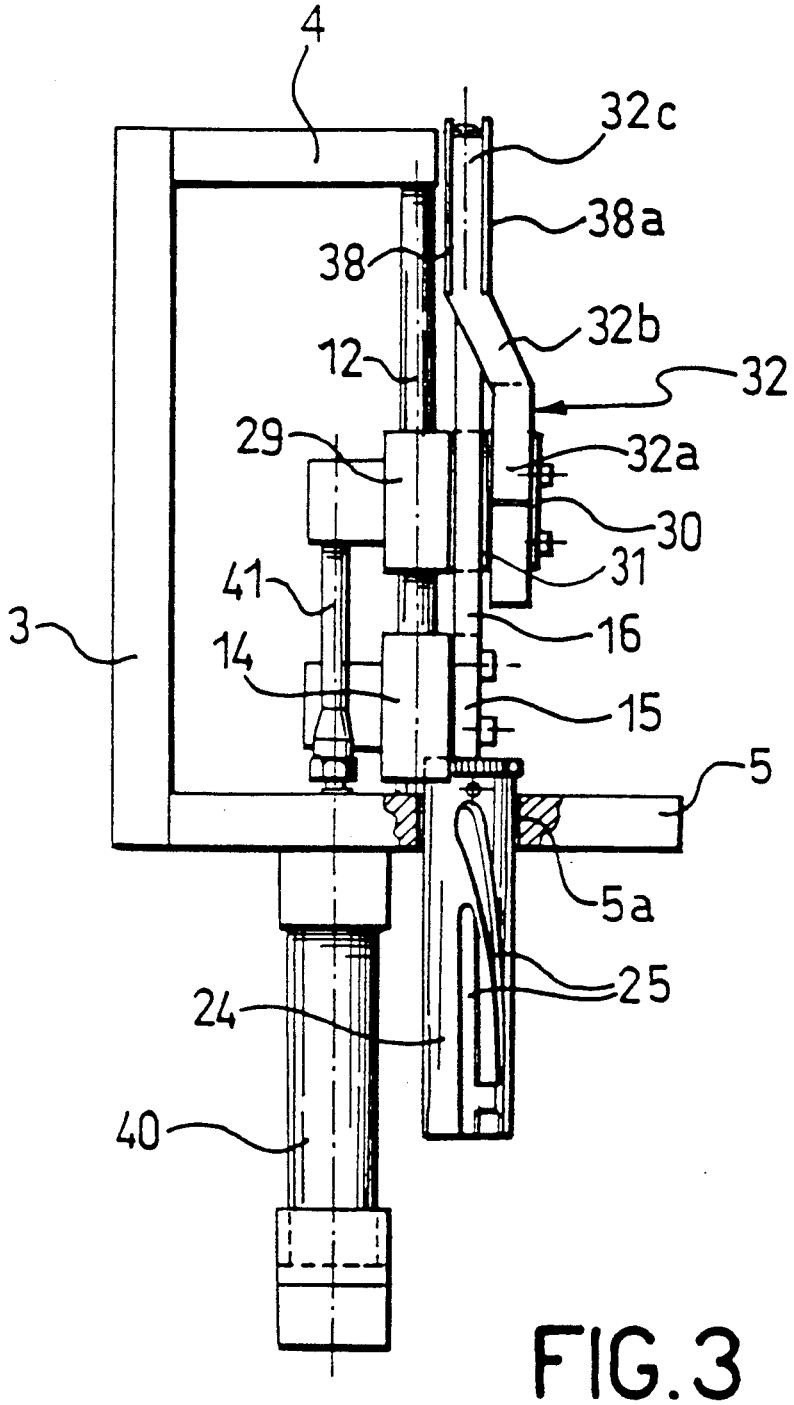
FIG. 3 is a side view of the same detail as shown in FIG. 2.
Figure 4:
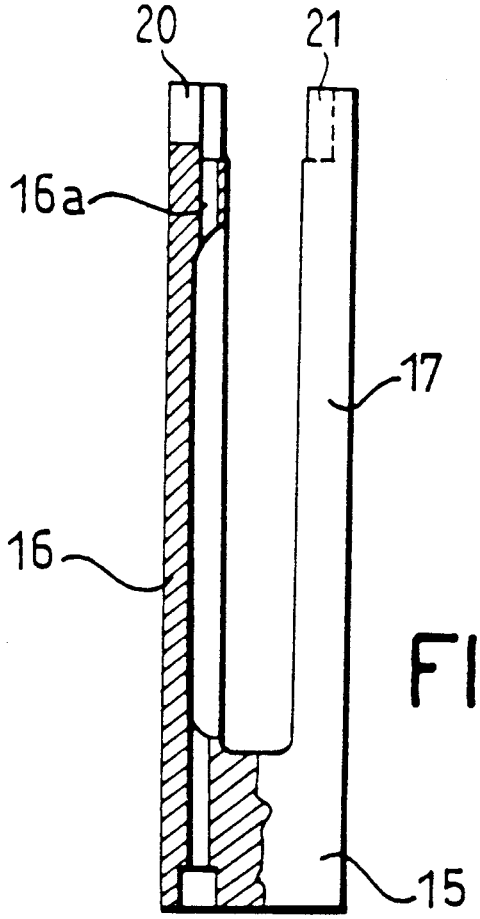
FIGS. 4 and 5 are enlarged scale views of further details of the labelling) machine shown in FIG. 1.
Figure 5:
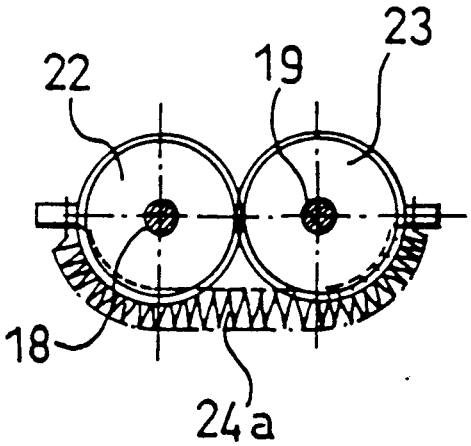

Attached to the top free end of the lever 32 (FIG. 3) are two vertical plates 38, 38*a* lying parallel to the plane wherein the angular displacements of the lever 32 take place and being arranged symmetrically about the arm 16 of the U-shaped holder 15. Said plates 38, 38*a* essentially cantilever out from the lever 32 toward the other lever 33.

An identical pair of vertical plates 39, 39*a* are attached to the free top end of the lever 33. These plates 39, 39*a* substantially cantilever out from the lever 33 toward the lever 32 and are supported symmetrically about the arm 17 of the U-shaped holder 15.

More specifically, and in accordance with a preferred embodiment, each of said levers 32, 33 comprises a lower section (32*a*, 33*a*) which lies vertically adjacent to the box-type body 30, an intermediate section (32*b*, 33*b*) which slopes down toward the ways 12, 13, and an upper section (32*c*, 33*c*) which lies vertically adjacent to a corresponding arm (16, 17) of the U-shaped holder, 15.

The box-type body 30, and its related air cylinders, the levers 32, 33 and their related pairs of top plates 38, 38*a* and 39, 39*a*, constitute a centering and holding (CT) arrangement which acts essentially to clamp on bag-type packages 9 lying on the rest surface 10, as explained hereinafter.

To drive the slide 29 along the ways 12 and 3, an air cylinder 40 is provided whose piston rod 41 is associated with the slide 29.

The labelling machine of this invention is further equipped with a device for picking up labels from the magazine 6.

Figure 6:
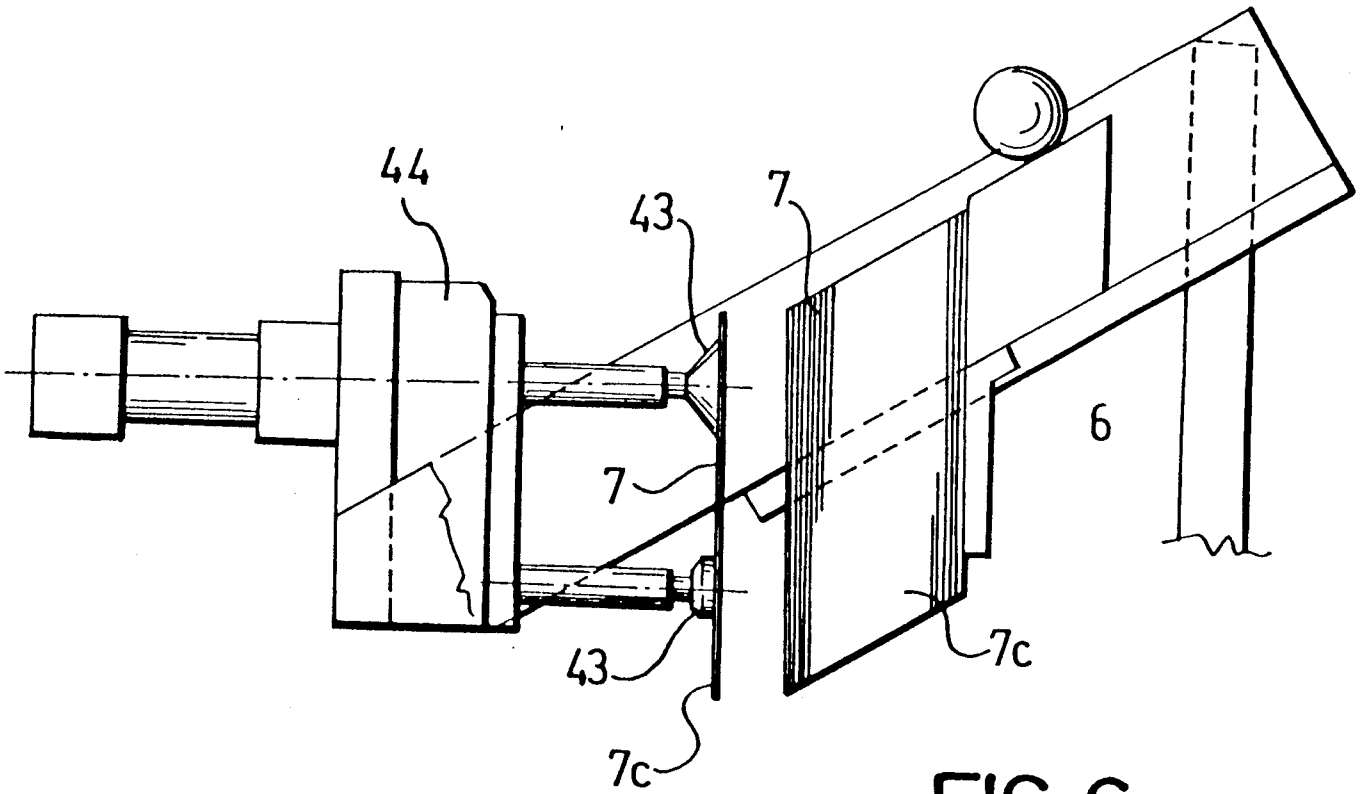
FIG. 6 is an enlarged scale detail view of the label magazine and its label pick-up device, wherewith the labelling machine of this invention is equipped.

This device is generally indicated at 44 in FIG. 6 and is of a kind known per se such as one comprising a plurality of suction cups 43 operated pneumatically and mounted on the ends of respective rods 44 for driving toward the magazine 6, picking up a label, and retreating out of said magazine.

The labelling method of this invention will be now described as implemented on the above-described labelling machine and with reference to the above-specified drawing figures.

In an initial condition, the slides 14 and 29 would be held in a bottom or lowered position. In this condition, the top ends of the arms 16, 17 would be in a position underlying the rest surface 10 supporting bag-type packages 9 to be labelled. Active on the levers 32, 33 are the piston rods 36, 36 of the upper air cylinders, thereby the levers would be held spread apart with related plate pairs 38, 38*a* and 39, 39*a* mutually away from their respective arms 16, 17 of the holder 15 (FIG. 2).

While still in this initial condition, the follower 26 engages in the upper section of the internal cam 25, and the cylindrical segment 24 occupies an angular position, with the spring 24*a* relaxed, to which there corresponds an angular position of the rods 18 and 19 with their respective cutouts 20, 21 set inclined and convergent toward the vertical axis of the holder 15.

A bag-type package 9 is fed on the rest surface 10 and halted thereon in a position with the neck portion 9*a* of said package protruding horizontally from the front outline of the surface and oriented in a random direction.

By operating the pick-up device 44, a label 7 is taken from the magazine 6 to a position where it is held upright vertically above the neck portion 9*a* of the package 9, at a location overlying it. More specifically, the label 7 is taken to and then held exactly vertically above the arm pair 16, 17 of the U-shaped holder 15.

Figure 9:
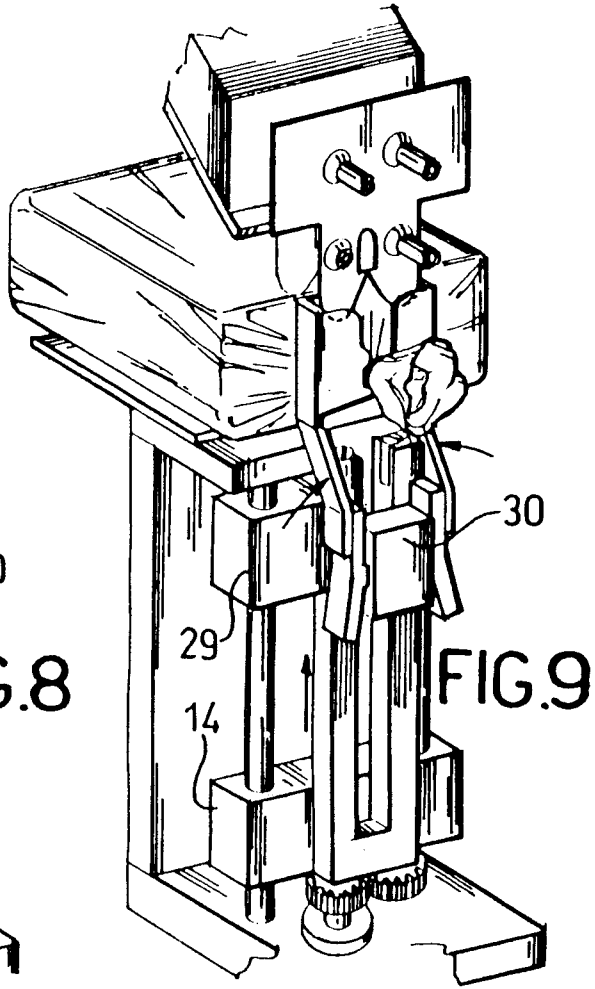
FIGS. 7 to 13 shows sequentially and in perspective the labelling machine of FIG. 1 at successive steps of performance of the inventive method.
Figure 8:
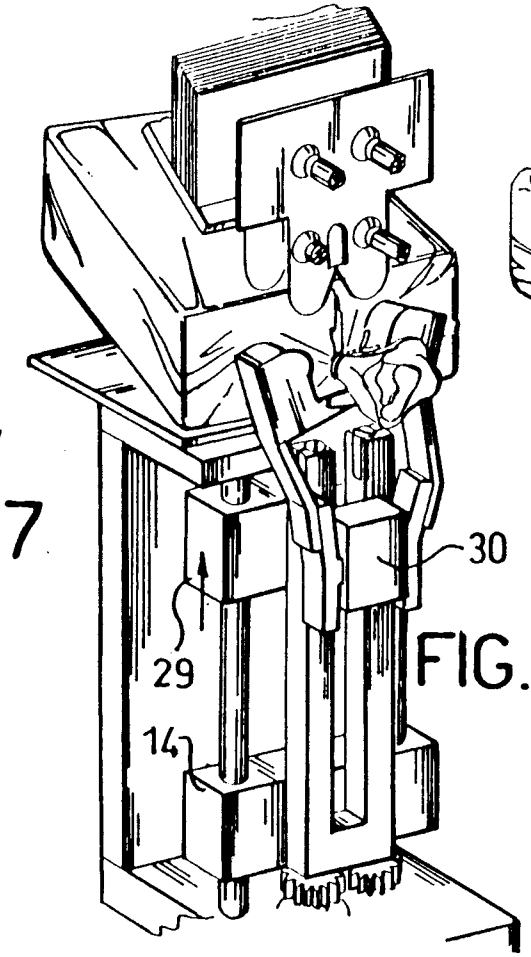
Figure 7:
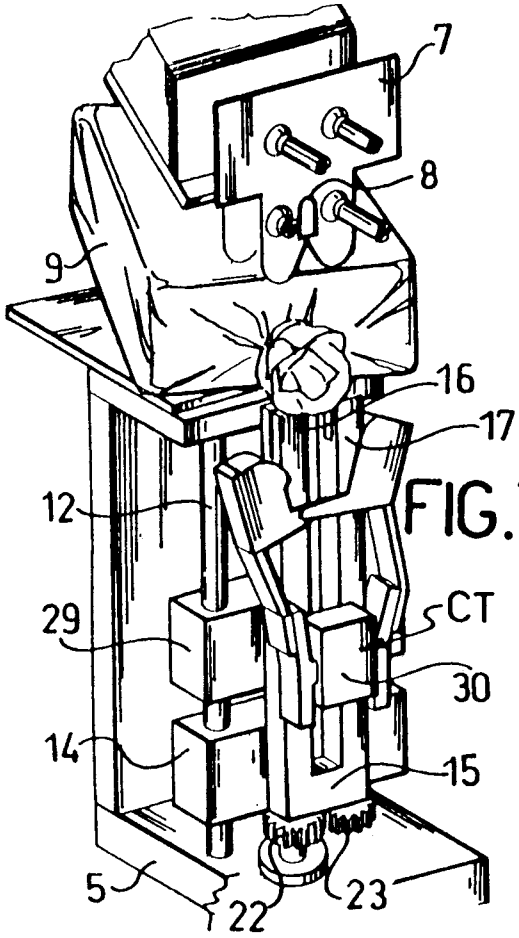

Presently the package 9 is centered on the rest surface 10. To accomplish this, through operation of the respective air cylinders, the slide 29 is taken to its upper position, while the plate pairs 38, 38*a* and 39, 39*a*, still in their spread condition, are concurrently moved to the neck portion 9*a* of the package 9. Now, by causing the piston rods 37, 37 of the lower air cylinders of the box-type holder 30 to act on the levers 32 and 33, the levers are shifted angularly to a closely set position. The consequent approach movements of the plate pairs 38, 38*a* and 39, 39*a* will cause the neck portion 9*a* of the package 9 to be centered relatively to the arms 16, 17 of the U-shaped holder 15 (FIGS. 8 and 9).

On completion of this step, bottom end portions of the extensions 7*b* and 7*c* of the label 7 are grasped, slightly twisted to spread them open and make the collar-like passageway 8 therebetween accessible.

Figure 11:
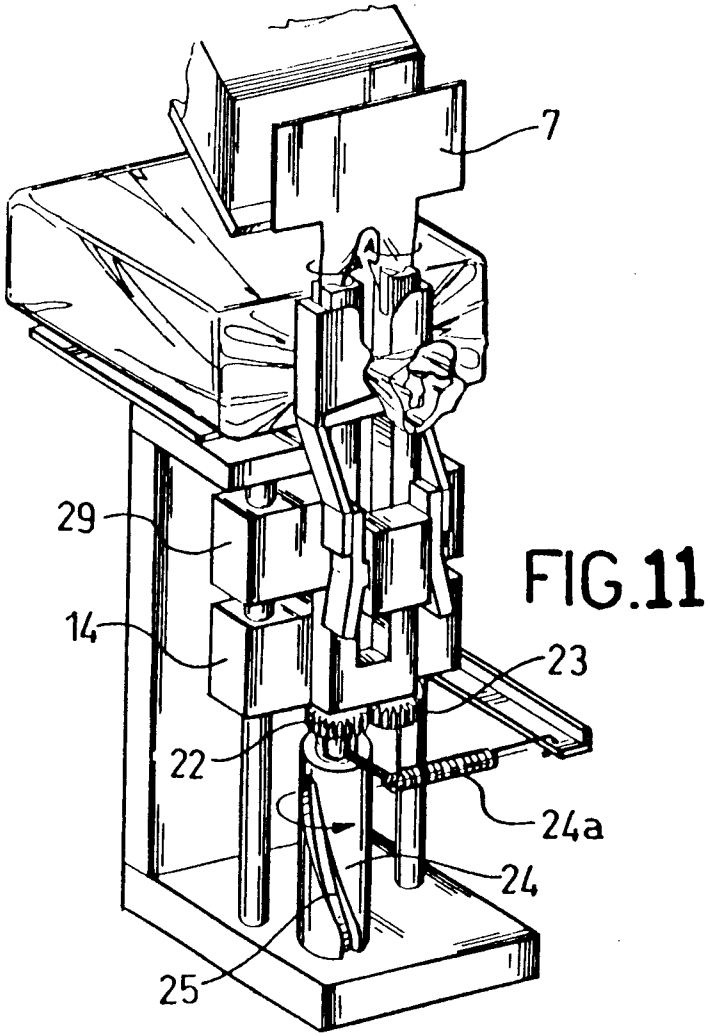
Figure 10:
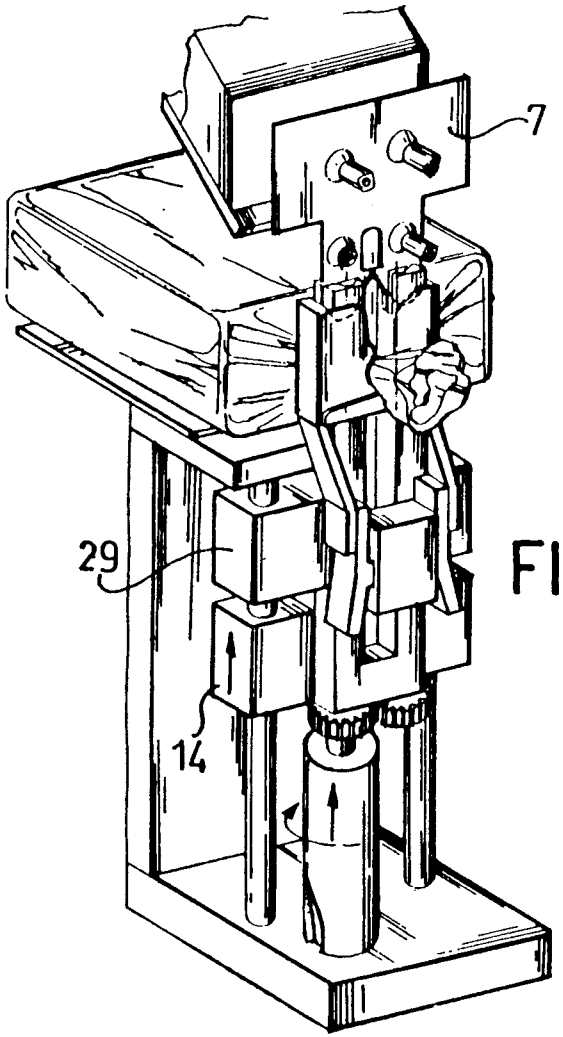

In particular, with reference to FIGS. 10 and 11, by operation of the air cylinder 27, the slide 14 is moved to its upper position, while concurrently lifting the U-shaped holder 15 and the segment 24 fast therewith. During this lifting movement, the engagement of the follower 26 in the internal cam 25 will drive the cylindrical segment 24 rotatively in a clockwise direction, thereby the rods 18, 19 will become displaced angularly through the engagement of the gear wheels 22 and 23 and against the bias force of the spring 24*a*. The extent of this displacement is preset such that on completion thereof the cutouts 20 and 21 formed on the tops of the rods 18 and 19 will be aligned together and right above the extensions 7*b* and 7*c* of the label 7. As the upward movement of the slide 14 continues, the thusly aligned cutouts will engage the end portions of the extensions 7*b* and 7*c* from below.

Again by operating the air cylinder 27, the slide 14 is then moved back to its initial position (lowered), along with the U-shaped holder 15 and the segment 24 carrying the internal cam 25. At the beginning of this movement, the engagement of the follower 26 in the internal cam 25 causes another angular movement of the rods 18, 19, and consequent positioning of the cutouts 20 and 21, inclined and convergent toward the vertical axis of the U-shaped holder 15. By this angular movement, the extensions 7*b* and 7*c* are twisted in the opposite direction, spread apart, and thus set for radial access to the collar-like passageway 8. By continuing the downward movement (FIG. 12), the label 7 will be wrapped around the neck portion 9*a* of the bag-type package 9. Thereafter, the slide 14 will continue its downward travel while the wrapper label 7 is "withheld" by the neck portion 9*a* itself of the package 9. Thus, the rods 18, 19 will automatically slip off the extensions 7*b*, 7*c* of the label 7 and allow them to resume their side-by-side position, requiring radial access to the collar-like passageway 8.

Figures 12, 13:
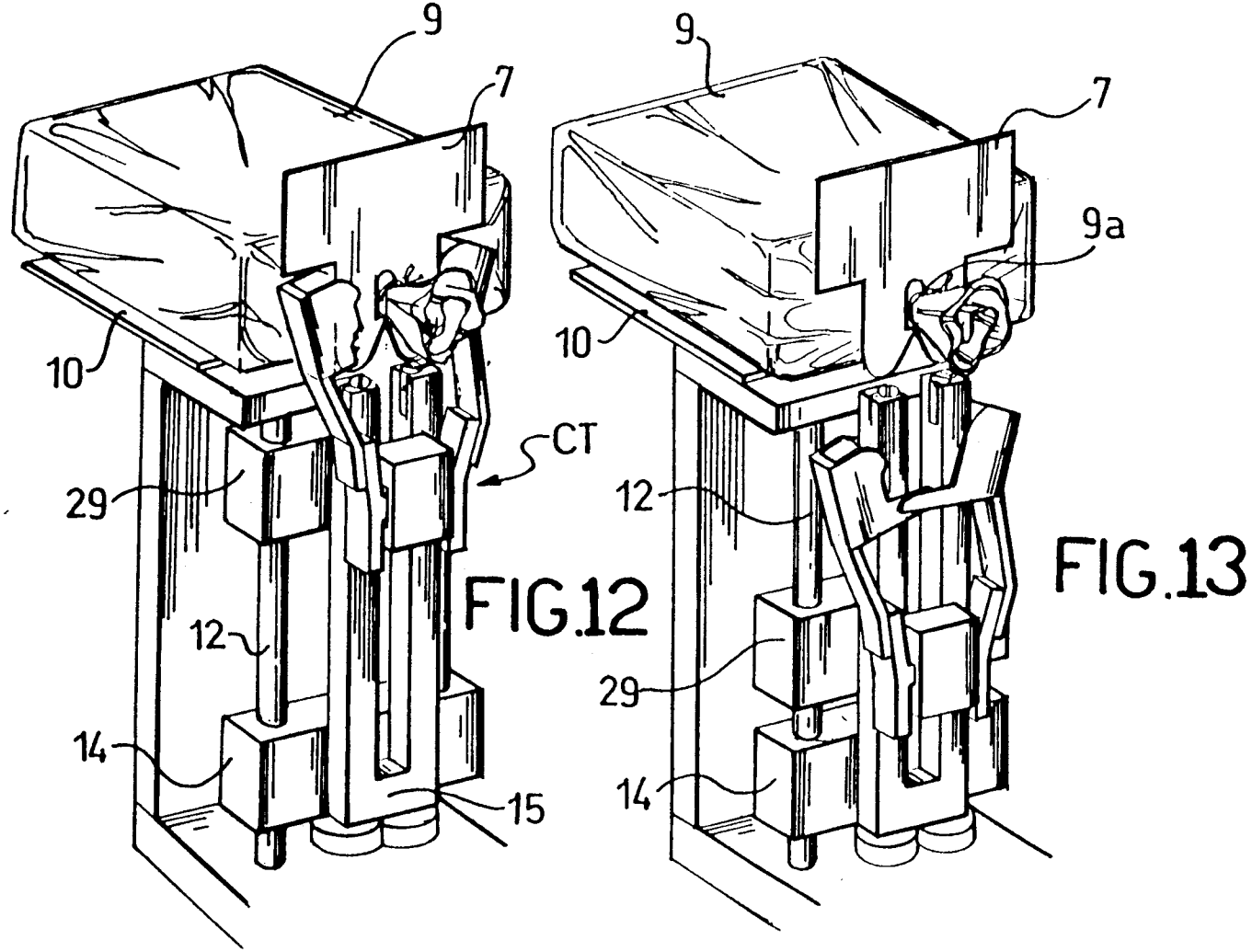

FIG. 13 shows the labelling machine of this invention restored to its initial position, and the implementation process for the method according to the invention is now complete.

I claim:

1. A method of attaching wrapper labels to the neck portions of bag-type packages, said wrapper labels being of a type comprising a label formed with two parallel coplanar extensions defining a collar-like passageway therebetween, wherein it comprises the steps of, positioning a bag-type package on rest surface such that the neck portion thereof will extend horizontally beyond said surface, positioning a label vertically while holding it vertically above the neck portion of said package at a location overlying it with the collar-like passageway of said label substantially centered on said neck portion, gripping the ends of said extensions from below by respective gripping means, slightly twisting said extensions by appropriate rotation of said gripping means, whereby spreading them open to make the collar-like passageway defined therebetween accessible, bringing the label vertically down while holding its respective extensions spread out so as to engage them on either sides of said neck portion, thereby the latter will become wrapped within said collar-like passageway, and moving said gripping means away from the respective extensions by further lowering said means while the label is withheld on the neck portion of said package.

2. A labelling machine for implementing the method of claim 1, comprising: a rest surface whereon a bag-type package is held in a work position with the neck portion of the package extending horizontally beyond said surface; a label magazine; a device for picking up a label from said magazine and holding the same upright vertically above the neck portion of said package; a slide movable along ways extending vertically beneath said rest surface; gripping means supported on said slide and comprising two rods having vertical axes and top ends formed with cutouts for engaging end portions of respective extensions of said label from below; means for moving said slide up and down; and means for driving said rods angularly in one direction and in the opposite direction about their respective vertical axes.

3. A machine according to claim 2, wherein said means for driving the rods in one direction and in the opposite direction about their respective vertical axes comprise a gear wheel keyed to one of said rods and enmeshed with a second gear wheel keyed to the other of said rods, a cylindrical segment attached to said gear wheel and extending along an axially aligned direction to the corresponding rod, said cylindrical segment being guided for rotary and sliding movements in a respective seat formed in the stationary structure of said machine, and an internal cam having a suitable profile and being formed longitudinally in said cylindrical segment and engaged by a follower carried fixedly on said structure.

4. A machine according to claim 3, wherein said rods fit slidably in respective through-going bores provided longitudinally in corresponding vertical arms affixed to said slide.

5. A machine according to claim 2, comprising a device for centering and holding the bag-type packages to the rest surface.

6. A machine according to claim 5, wherein said centering and holding device is of an essentially clamp-like type and is carried on a movable slide along said ways.

* * * * *